US011656038B2

(12) United States Patent
Retersdorf et al.

(10) Patent No.: US 11,656,038 B2
(45) **Date of Patent: *May 23, 2023**

(54) HEAT EXCHANGER WITH ENHANCED END SHEET HEAT TRANSFER

(71) Applicant: Hamilton Sundstrand Corporation, Charlotte, NC (US)

(72) Inventors: Alan Retersdorf, Avon, CT (US); Luke J. Mayo, Coventry, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 84 days.

This patent is subject to a terminal disclaimer.

(21) Appl. No.: 17/319,026

(22) Filed: May 12, 2021

(65) Prior Publication Data

US 2021/0262743 A1 Aug. 26, 2021

Related U.S. Application Data

(62) Division of application No. 16/126,794, filed on Sep. 10, 2018, now Pat. No. 11,035,626.

(51) Int. Cl.
*F28F 9/02* (2006.01)
*F28D 1/02* (2006.01)
(Continued)

(52) U.S. Cl.
CPC ..... *F28F 9/02* (2013.01); *F28D 1/024* (2013.01); *F28F 9/001* (2013.01); *F28D 1/053* (2013.01);
(Continued)

(58) Field of Classification Search
CPC ..... F28F 9/02; F28F 9/001; F28F 2009/0292; F28F 9/005; F28D 1/024; F28D 1/053;
(Continued)

(56) References Cited

U.S. PATENT DOCUMENTS 2,782,009 A 2/1957 Rippingille
2,875,986 A 3/1959 Holm
(Continued)

FOREIGN PATENT DOCUMENTS

EP 3163244 A1 5/2017
EP 3187715 A1 7/2017
(Continued)

OTHER PUBLICATIONS

European Search Report Application No. 19196157.2; dated Feb. 10, 2020; pp. 7.

*Primary Examiner* — Ljiljana V. Ciric
(74) *Attorney, Agent, or Firm* — Cantor Colburn LLP

(57) ABSTRACT

A heat exchanger with increased heat transfer capability includes first and second end plates, tubes extending between the first and second end plates and fins disposed between the tubes. The heat exchanger is disposable within and differs in shape from a space defined between first and second walls such that corners of the first end plate abut the first wall and a point of the second end plate abuts the second wall, the first wall diverges from the corners of the first end plate to define a first open region and the second wall diverges from the point of the second end plate to define second open regions. At least one of the first end plate and the second end plates includes enhancements fluidly communicative with the at least one corresponding one of the first open region and the second open regions.

7 Claims, 1 Drawing Sheet

(51) Int. Cl.
*F28F 9/00* (2006.01)
*F28D 1/053* (2006.01)
*F28D 21/00* (2006.01)

(52) U.S. Cl.
CPC ..... *F28D 2001/0273* (2013.01); *F28D 2021/0026* (2013.01); *F28F 2009/0292* (2013.01)

(58) Field of Classification Search
CPC ..... F28D 2001/0273; F28D 2021/0026; F28D 1/0233; F28D 7/16
See application file for complete search history.

(56) References Cited

U.S. PATENT DOCUMENTS 2,953,110 A * 9/1960 Etheridge ..... F28D 9/00 165/157
3,364,548 A 1/1968 Marco
3,525,390 A 8/1970 Rothman
3,532,160 A 10/1970 Garrison
3,613,782 A 10/1971 Mason et al.
3,752,226 A 8/1973 Bullock
3,759,323 A 9/1973 Dawson et al.
3,818,984 A 6/1974 Nakamura et al.
3,866,674 A 2/1975 Tramuta et al.
4,031,953 A 6/1977 Kline
4,116,271 A * 9/1978 De Lepeleire ..... F28F 9/02 165/DIG. 356
4,249,596 A 2/1981 Tutak et al.
4,291,752 A 9/1981 Bridgnell
4,338,998 A 7/1982 Goloff
4,343,355 A 8/1982 Goloff et al.
4,415,024 A 11/1983 Baker
4,442,886 A 4/1984 Dinulescu
4,548,260 A 10/1985 Stachura
4,596,285 A 6/1986 Dinulescu
5,113,930 A 5/1992 Le Gauyer
5,645,125 A 7/1997 Kroetsch et al.
6,192,975 B1 2/2001 Yanai et al.
6,283,199 B1 9/2001 Nakamura et al.
6,474,408 B1 11/2002 Yeh et al.
6,918,433 B2 7/2005 Kontu
7,017,656 B2 3/2006 Beddome et al.
7,669,645 B2 3/2010 Nakamura
8,215,378 B2 7/2012 Nash et al.
8,784,047 B2 7/2014 Elder
9,051,943 B2 6/2015 Elder
9,080,815 B2 * 7/2015 Hallmann ..... F28D 9/0012
9,267,434 B2 2/2016 Campbell et al.
9,714,796 B2 7/2017 Heinio
9,732,702 B2 8/2017 Ueda
9,752,835 B2 9/2017 Waldman et al.
10,066,874 B2 * 9/2018 Pitkänen ..... F28D 9/0006
10,087,813 B2 10/2018 Okami et al.
10,156,404 B2 12/2018 Ueda
10,215,497 B2 2/2019 Noishiki et al.
10,222,129 B2 3/2019 Finstad et al.
10,247,296 B2 4/2019 Van Der Merwe et al.
10,316,750 B2 6/2019 Loebig et al.
10,337,800 B2 7/2019 Taylor
10,371,053 B2 8/2019 Loebig et al.
10,724,806 B2 7/2020 Seo
10,830,540 B2 11/2020 Sennoun et al.
10,876,794 B2 * 12/2020 Bergh ..... F28G 13/00
11,035,626 B2 * 6/2021 Retersdorf ..... F28D 7/16
2003/0000687 A1 1/2003 Mather et al.
2005/0279080 A1 12/2005 Costen et al.
2007/0289581 A1 12/2007 Nakamura
2010/0314088 A1 12/2010 Yoo et al.
2011/0073292 A1 3/2011 Datta et al.
2011/0146229 A1 6/2011 Bajusz et al.
2011/0247318 A1 10/2011 Kuroyanagi et al.
2012/0160466 A1 6/2012 Pollard et al.
2014/0332183 A1 11/2014 Choi et al.
2016/0109189 A1 4/2016 Davies et al.
2016/0231064 A1 8/2016 Kironn et al.
2017/0198719 A1 7/2017 Cerny et al.
2017/0254596 A1 * 9/2017 Noel-Baron ..... F28D 9/0012
2017/0268413 A1 9/2017 Kinder et al.
2017/0328279 A1 11/2017 Sennoun et al.
2018/0058473 A1 3/2018 Kenworthy et al.
2018/0292142 A1 10/2018 Schouten et al.
2019/0072343 A1 3/2019 Caarrera et al.
2019/0154349 A1 * 5/2019 Jensen ..... F28D 9/0006

FOREIGN PATENT DOCUMENTS

EP 3290846 A1 3/2018
EP 3372941 A1 * 9/2018 ..... F28D 21/0014
EP 3620740 A1 * 3/2020 ..... F28D 1/0233
WO WO-8102060 A * 7/1981 ..... F28D 9/0025
WO WO-8200194 A1 * 1/1982
WO 2015156815 A1 10/2015

* cited by examiner

HEAT EXCHANGER WITH ENHANCED END SHEET HEAT TRANSFER

CROSS-REFERENCE TO RELATED APPLICATIONS

This application is a division of U.S. application Ser. No. 16/126,794 filed Sep. 10, 2018, the disclosure of which is incorporated herein by reference in its entirety.

BACKGROUND

The following description relates to heat exchangers and, more specifically, to a heat exchanger with end sheet enhancements that provide for enhanced heat transfer.

Heat exchangers are typically devices that bring two physical elements, such as hot and cold fluids, into thermal communication with each other. A heat exchanger in a fan duct stream of an engine, the hot fluid could be hot air and the cold fluid could be a cooler air stream. The hot air is flown through tubes extending throughout the heat exchanger and the air stream is directed through a duct and toward fins of the heat exchanger which are thermally communicative with the tubes. In this way, heat of the hot air is transferred to the material of the tubes, from the tubes to the fins and from the fins to the air stream. The temperature of the hot air is thus reduced while the temperature of the air stream can be increased.

Currently, heat exchangers are being manufactured so that they tend to transfer an increasing amount of heat and so that they can be more effective as system loads increase while installation volumes decrease.

BRIEF DESCRIPTION

According to an aspect of the disclosure, a heat exchanger with increased heat transfer capability is provided. The heat exchanger includes first and second end plates, tubes extending between the first and second end plates and fins disposed between the tubes. The heat exchanger is disposable within and differs in shape from a space defined between first and second walls such that end corners of the first end plate abut the first wall and a point of the second end plate abuts the second wall, the first wall diverges from the end corners of the first end plate to define a first open region and the second wall diverges from the point of the second end plate to define second open regions. At least one of the first end plate and the second end plates includes enhancements fluidly communicative with the at least one corresponding one of the first open region and the second open regions.

In accordance with additional or alternative embodiments, the space is annular and the heat exchanger is rectangular.

In accordance with additional or alternative embodiments, the first open region is an annular segment and the second open regions have an increasing dimension with increasing distance from the point of the second plate.

In accordance with additional or alternative embodiments, the first end plate and the second end plates include enhancements fluidly communicative with the first open region and the second open regions, respectively.

In accordance with additional or alternative embodiments, the enhancements comprise external fins.

In accordance with additional or alternative embodiments, the enhancements include dimpled features.

In accordance with additional or alternative embodiments, the enhancements include surface texturing.

According to an aspect of the disclosure, a heat exchanger with increased heat transfer capability is provided and includes first and second end plates, tubes extending between the first and second end plates and fins disposed between the tubes. The heat exchanger is disposable within and differs in shape from a space defined between first and second walls such that end corners of the first end plate abut the first wall and a point of the second end plate abuts the second wall, the first wall diverges from the end corners of the first end plate to define a first open region and the second wall diverges from the point of the second end plate to define second open regions. The first end plate and the second end plates include enhancements fluidly communicative with the first open region and with the second open regions, respectively.

In accordance with additional or alternative embodiments, the space is annular and the heat exchanger is rectangular.

In accordance with additional or alternative embodiments, the first open region is an annular segment and the second open regions have an increasing dimension with increasing distance from the point of the second plate.

In accordance with additional or alternative embodiments, the enhancements include external fins.

In accordance with additional or alternative embodiments, the enhancements include dimpled features.

In accordance with additional or alternative embodiments, the enhancements include surface texturing.

According to another aspect of the disclosure, a duct system is provided and includes a duct defining a space between first and second walls and a heat exchanger with increased heat transfer capability. The heat exchanger includes first and second end plates, tubes extending between the first and second end plates and fins disposed between the tubes. The heat exchanger is disposable within and differs in shape from the space with end corners of the first end plate abutting the first wall, a point of the second end plate abutting the second wall, the first wall diverging from the end corners of the first end plate to define a first open region and the second wall diverging from the point of the second end plate to define second open regions. The first end plate and the second end plates include enhancements fluidly communicative with the first open region and with the second open regions, respectively.

In accordance with additional or alternative embodiments, the duct includes a conical duct.

In accordance with additional or alternative embodiments, the space is annular and the heat exchanger is rectangular.

In accordance with additional or alternative embodiments, the first open region is an annular segment and the second open regions have an increasing dimension with increasing distance from the point of the second plate.

In accordance with additional or alternative embodiments, the enhancements include external fins.

In accordance with additional or alternative embodiments, the enhancements include dimpled features.

In accordance with additional or alternative embodiments, the enhancements include surface texturing.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

These and other advantages and features will become more apparent from the following description taken in conjunction with the drawings.

DETAILED DESCRIPTION

For heat exchangers with an open, non-ducted inlet (e.g., heat exchangers in a fan duct stream of an engine), heat transfer occurs not only within the heat exchanger, but also along the end sheets. The end sheets can be manufactured to enhance the heat transfer through the end sheet by enhancements including, but not limited to, at least one or more of dimpling, the additional of external fins, chemical etching and knurling of the external surfaces of the end sheets. For a more typical ducted configuration, the end sheets contribute a negligible amount of heat transfer capability despite the fact that these end sheets are likely to see similar flows to that of the finned passages and can be expected to achieve heat transfer performance similar to a flat plate. Adding heat transfer features to the end sheets can therefore provide a significant improvement to heat exchanger thermal performance with minimal increases to heat exchanger volumes.

Figure 1:
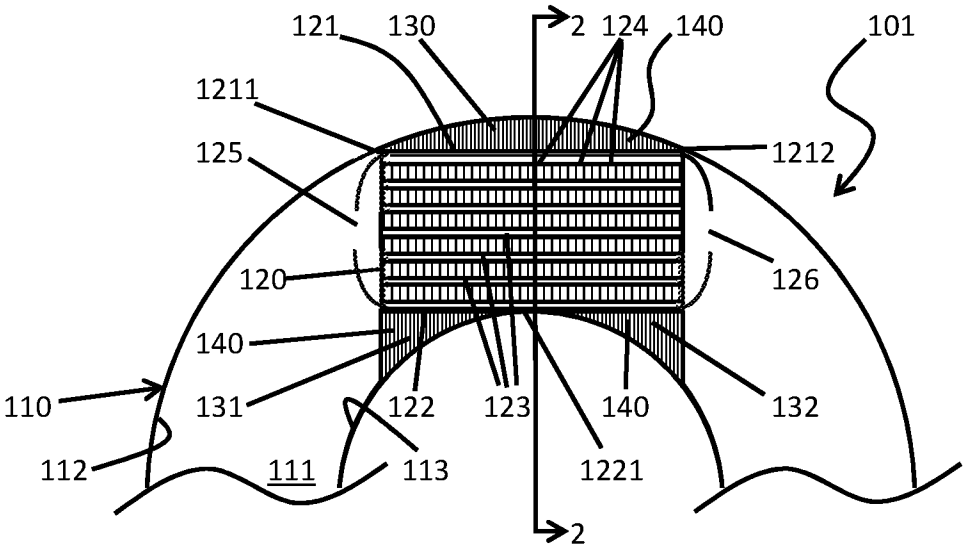
FIG. 1 is an axial view of a heat exchanger with end sheets that are capable of providing enhanced heat transfer in a fan duct in accordance with embodiments.
Figure 2:
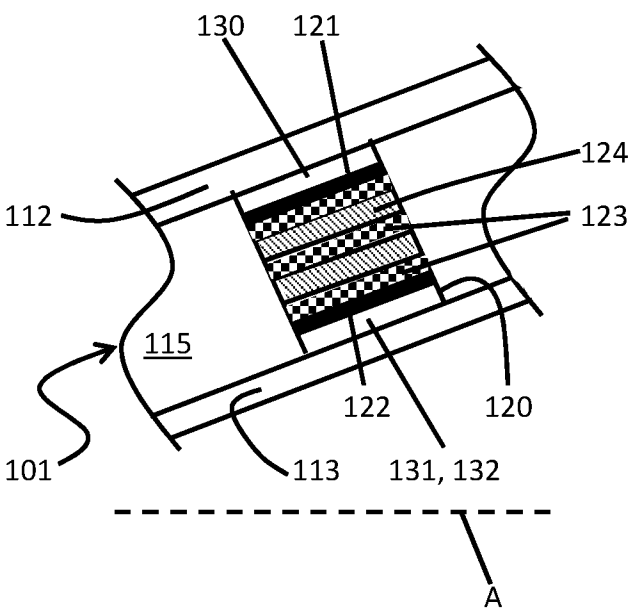
FIG. 2 is a side view of the heat exchanger of FIG. 1 taken along line 2-2.

With reference to FIGS. 1 and 2, a duct system 101 is provided and may be configured as a duct for an air stream generated by a fan in an engine, for example.

The duct system 101 includes a duct 110 in which a space 111 is defined between a first wall 112 and a second wall 113. The first wall 112 can be an annular wall and the second wall 113 can be an annular wall that is smaller than and disposed within the first wall 112 such that the space 111 is an annular space. In addition, as shown in FIG. 2, the duct 110 can be provided as a conical duct 115 (see FIG. 1) in which the first and second walls 112 and 113 are angled relative to a central longitudinal axis A.

While the duct 110 could be configured as a duct for an air stream generated by a fan in an engine, for example, the duct 110 could also be configured as another type of duct or manifold for various applications. For purposes of clarity and brevity, however, the following description will relate to the case in which the duct 110 is a conical duct for an air stream generated by a fan in an engine.

The duct system 101 further includes a heat exchanger 120 that is disposable within the space 111. The heat exchanger 120 includes a first end plate 121, a second end plate 122, tubes 123 extending between the first and second end plates 121 and 122 and fins 124. The fins 124 are disposed between the tubes 123 and exposed to the air stream with the heat exchanger 120 installed within the space 111. The heat exchanger 120 further includes an inlet 125, such as an inlet duct, and an outlet 126, such as an outlet duct. During operations of the heat exchanger, fluid is received via the inlet 125, passes through the tubes 123 and exits via the outlet 126. In the exemplary case in which the fluid is hot, such as the case in which the fluid is a heated air, and the air stream is relatively cold, heat from the hot air is transferred into the material of the tubes 123, and then into the fins 124 and finally into the air stream as the air stream flows over and around the fins 124.

While the heat exchanger 120 is disposable within the space 111, the heat exchanger 120 has a different shape from the space 111. For example, where the space 111 is annular, the heat exchanger 120 may have a rectangular shape (i.e., the first and second end plates 121 and 122 are parallel, the same length and lined up with one another). As such, when the heat exchanger 120 is disposed in the space 111, opposite end corners 1211 and 1212 of the first end plate 121 abut the first wall 112 and a point 1221 of the second end plate 122 abuts the second wall 113. Here, the first wall 112 diverges from the opposite end corners 1211 and 1212 of the first end plate 121 to define a first open region 130 with an annular segment shape between the opposite end corners 1211 and 1212 and the second wall 113 diverges from the point 1221 of the second end plate 122 to define second open regions 131 and 132 on either side of the point 1221. The second open regions have an increasing dimension (i.e., a geometrically increasing depth from end plate 122) with an increasing distance from the point 1221 of the second plate 122.

Normally, with rectangular heat exchangers, flows of the air stream will flow through the first open region 130 and the second open regions 131 and 132 but the first open region 130 and the second open regions 131 and 132 would nevertheless be empty of heat exchanger components. Thus, an opportunity for making use of the flows in those regions for additional heat transfer is lost. As shown in FIGS. 1 and 2, however, at least one of the first end plate 121 and the second end plate 122 includes enhancements 140. The enhancements are fluidly communicative with the corresponding at least one of the first open region 130 and the second open regions 131 and 132 and provide for additional heat transfer capability.

Figure 3:
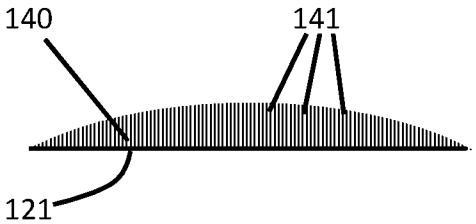
FIG. 3 is a schematic illustration of an end plate with enhancements in accordance with embodiments.
Figure 4:
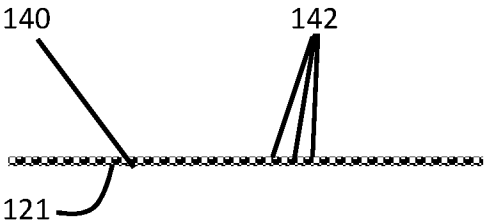
FIG. 4 is a schematic illustration of an end plate with enhancements in accordance with embodiments.
Figure 5:
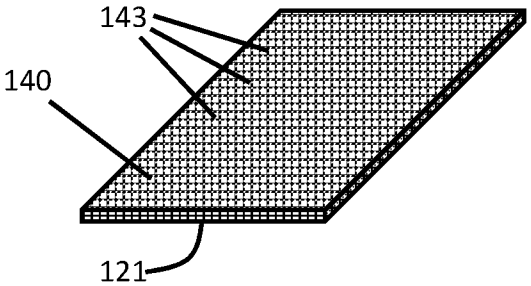
FIG. 5 is a schematic illustration of an end plate with enhancements in accordance with embodiments.

With continued reference to FIGS. 1 and 2 and with additional reference to FIGS. 3-5, the enhancements 140 may include at least one or more of external fins 141 (see FIG. 3), dimpled features 142 (see FIG. 4) and surface texturing 143 (see FIG. 5) due to chemical etching or knurling.

Technical effects and benefits of the present disclosure are the provision of a heat exchanger having end plates that provide for enhanced heat transfer particularly for those cases in which the shape of the heat exchanger differs from a shape of the space in which the heat exchanger is disposed.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A heat exchanger system with increased heat transfer capability, the heat exchanger system comprising:

a heat exchanger comprising:

first and second end plates;

tubes extending between the first and second end plates; and fins disposed between the tubes, the heat exchanger being disposable within and differing in shape from a space defined between first and second walls such that:

corners of the first end plate abut the first wall and a point of the second end plate abuts the second wall, the first wall diverges from the corners of the first end plate to define a first open region, and the second wall diverges from the point of the second end plate to define second open regions, and at least one of the first end plate and the second end plates comprises enhancements fluidly communicative with the at least one corresponding one of the first open region and the second open regions.

2. The heat exchanger system according to claim 1, wherein the space is annular and the heat exchanger is rectangular.

3. The heat exchanger system according to claim 1, wherein:

the first open region is an annular segment, and the second open regions have an increasing dimension with increasing distance from the point of the second plate.

4. The heat exchanger system according to claim 1, wherein the first end plate and the second end plates comprise enhancements fluidly communicative with the first open region and the second open regions, respectively.

5. The heat exchanger system according to claim 1, wherein the enhancements comprise external fins.

6. The heat exchanger system according to claim 1, wherein the enhancements comprise dimpled features.

7. The heat exchanger system according to claim 1, wherein the enhancements comprise surface texturing.

* * * * *